US011719450B2

(12) United States Patent
Fukuyama et al.

(10) Patent No.: US 11,719,450 B2
(45) Date of Patent: Aug. 8, 2023

(54) AIR-CONDITIONING SYSTEM

(71) Applicant: DAIKIN INDUSTRIES, LTD., Osaka (JP)

(72) Inventors: Yuuta Fukuyama, Osaka (JP); Hiroki Sasayama, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/863,919

(22) Filed: Jul. 13, 2022

(65) Prior Publication Data

US 2022/0349601 A1 Nov. 3, 2022

Related U.S. Application Data

(63) Continuation of application No. PCT/JP2021/001398, filed on Jan. 18, 2021.

(30) Foreign Application Priority Data

Feb. 5, 2020 (JP) ..... 2020-018221

(51) Int. Cl.

| | |
|---|---|
| ***F24F 11/36*** | (2018.01) |
| ***F24F 11/89*** | (2018.01) |
| ***F24F 11/56*** | (2018.01) |
| ***F25B 41/20*** | (2021.01) |
| ***F25B 49/02*** | (2006.01) |
| ***F24F 110/65*** | (2018.01) |

(52) U.S. Cl.

CPC ..... *F24F 11/36* (2018.01); *F24F 11/56* (2018.01); *F24F 11/89* (2018.01); *F25B 41/20* (2021.01); *F25B 49/02* (2013.01); *F24F 2110/65* (2018.01)

(58) Field of Classification Search

CPC .. F24F 11/36; F24F 11/56; F24F 11/89; F24F 2110/65; F25B 41/20; F25B 49/02

See application file for complete search history.

(56) References Cited

U.S. PATENT DOCUMENTS 4,152,902 A * 5/1979 Lush ..... F04C 28/02 62/157
4,311,190 A * 1/1982 Walley ..... F24F 11/30 165/265

(Continued)

FOREIGN PATENT DOCUMENTS

JP 2013-210110 A 10/2013
JP 2016-151395 A 8/2016

(Continued)

OTHER PUBLICATIONS

International Search Report for PCT/JP2021/001398 dated Mar. 30, 2021.

(Continued)

*Primary Examiner* — Henry T Crenshaw

(74) *Attorney, Agent, or Firm* — Birch, Stewart, Kolasch & Birch, LLP

(57) ABSTRACT

An air-conditioning system includes: an air conditioner including an outdoor unit and a plurality of indoor units each provided in a corresponding one of a plurality of indoor spaces and each including a first control unit; and a second control unit capable of communicating with the first control units. Each first control unit is capable of communicating with a countermeasure device if the countermeasure device is installed in correspondence with one of the indoor spaces where the first control unit is located. The second control unit has a first function of prohibiting operation of the air conditioner if a first condition where communication between the first control unit and the countermeasure device is not established in any of the indoor units is satisfied.

13 Claims, 7 Drawing Sheets

(56) References Cited

U.S. PATENT DOCUMENTS

| | | | | |
|---|---|---|---|---|
| 2013/0324027 | A1* | 12/2013 | Davis | F24F 11/0001 454/258 |
| 2018/0045424 | A1* | 2/2018 | Yajima | F24F 7/007 |
| 2020/0124306 | A1* | 4/2020 | Kowald | F24F 11/526 |
| 2020/0318840 | A1* | 10/2020 | Wada | F25B 49/02 |
| 2022/0260293 | A1* | 8/2022 | Minami | F25B 41/42 |

FOREIGN PATENT DOCUMENTS

| | | | |
|---|---|---|---|
| JP | 2017-36890 | A | 2/2017 |
| JP | 2019-174110 | A | 10/2019 |
| JP | 2019-215153 | A | 12/2019 |
| JP | 2016-151395 | * | 1/2023 |
| WO | WO 2016/148003 | A1 | 9/2016 |

OTHER PUBLICATIONS

Written Opinion of the International Searching Authority for PCT/JP2021/001398 (PCT/ISA/237) dated Mar. 30, 2021.

English translation of International Preliminary Report on Patentability and Written Opinion of the International Searching Authority for International Application No. PCT/JP2021/001398, dated Aug. 18, 2022.

Extended European Search Report dated May 9, 2023 in counterpart European Application No. 21750355.6.

* cited by examiner

FIG.7

| ASHRAE Number | Component | Mass% | Alternative |
|---|---|---|---|
| R1234yf | R1234yf | (100) | R134a |
| R1234ze(E) | R1234ze(E) | (100) | R134a |
| | R1234yf/R134a/R152a | (82/7/11) | R134a |
| R516A | R1234yf/R134a/R152a | (77.5/8.5/14.0) | R134a |
| R445A | R744/R134a/R1234ze(E) | (6.0/9.0/85.0) | R134a |
| R444A | R32/R152a/R1234ze(E) | (12/5/83) | R134a |
| | R32/R125/R1234yf | (15/25/60) | R22/407 |
| R454C | R32/R1234yf | (21.5/78.5) | R22/407 |
| | R32/R152a/R1234ze(E) | (45/20/35) | R22/407 |
| R444B | R32/R152a/R1234ze(E) | (41.5/48.5/10) | R22/407 |
| | R744/R32/R1234ze(E) | (7/30/63) | R22/407 |
| R454A | R32/R1234yf | (35/65) | R404A |
| R454A | R32/R1234yf | (35/65) | R404A |
| R454C | R32/R1234yf | (21.5/78.5) | R404A |
| | R32/R1234yf/R152a/R1234ze(E) | (40/20/10/30) | R404A |
| R455A | R744/R32/R1234yf | (3.0/21.5/75.5) | R404A |
| | R32/R1234yf/R134a | (28/51/21) | R404A |
| | R32/R1234yf/R152a | (35/55/10) | R404A |
| | R32/R1234yf | (29/71) | R404A |
| | R-32/R290/R1234yf | (21.0/7.9/71.1) | R404A |
| R457A | R32/R1234yf/R152a | (18/70/12) | R404A |
| R459B | R32/R1234yf/R1234ze(E) | (21/69/10) | R404A |
| | R32/R134a | (50/50) | R404A |
| | R32/R1234yf | (40/60) | R410A |
| R452B | R32/R125/R1234yf | (67/7/26) | R410A |
| | R32/R1234yf | (72.5/27.5) | R410A |
| R454B | R32/R1234yf | (68.9/31.1) | R410A |
| | R32/R125/R1234ze(E) | (68/15/17) | R410A |
| R447B | R32/R125/R1234ze(E) | (68/8/24) | R410A |
| R32 | R32 | (100) | R410A |
| R447A | R32/R1234ze(E)/R125 | (68/28.5/3.5) | R410A |
| | R32/R1234yf/R1234ze(E) | (73/15/12) | R410A |
| | R32/R1234ze(E) | (72/27) | R410A |
| R446A | R32/R1234ze(E)/Butane | (68/29/3) | R410A |
| | R32/R1234yf/R134a | (50/40/10) | R410A |
| R459A | R32/R1234yf/R1234ze(E) | (68/26/6) | R410A |
| | R1123/R32 | (32/68) | R410A |
| | R1123/R32 | (40/60) | R410A |
| | R1123/R32 | (45/55) | R410A |
| | R1123/R32/R1234yf | (19/55/26) | R410A |
| | R1123/R32/R1234yf | (40/44/16) | R410A |
| | R1123 | (100) | R410A |
| | R744/R32/R1234ze(E) | (6/60/34) | R410A |
| | R32/R134a/R1234ze | (76/6/18) | R410A |
| | R32/R152a | (95/5) | R410A |
| | R32/R134a | (95/5) | R410A |

AIR-CONDITIONING SYSTEM

CROSS REFERENCE TO RELATED APPLICATIONS

This application is a Continuation of PCT International Application No. PCT/JP2021/001398, filed on Jan. 18, 2021, which claims priority under 35 U.S.C. 119(a) to Patent Application No. 2020-018221, filed in Japan on Feb. 5, 2020, all of which are hereby expressly incorporated by reference into the present application.

TECHNICAL FIELD

The present disclosure relates to an air-conditioning system.

BACKGROUND ART

Patent Document 1 discloses an air conditioner including a plurality of indoor units and an outdoor unit connected together through a refrigerant circuit. The plurality of indoor units of the air conditioner are grouped by spaces to be air-conditioned. Unless a signal from a ventilator installed in correspondence with each of the groups or from a refrigerant leakage detector installed in correspondence with each of the groups is input to a controller, the air conditioner prevents operation including trial operations of the plurality of indoor units and the outdoor unit.

One of the refrigerant leakage detectors of the air conditioner detecting a refrigerant causes the ventilator assigned to the group corresponding to the one of the refrigerant leakage detectors to perform a refrigerant discharge operation. To achieve the refrigerant discharge operation, signal transmission systems between devices including the refrigerant leakage detectors need to be reliably connected together. To satisfy the need, if a situation where the signal transmission systems between the devices are not reliably connected together at the installation site occurs (in other words, if no signals from the refrigerant leakage detectors or from the ventilators are input to the controller of the air conditioner), the controller prohibits the operation including the trial operations of the indoor units and the outdoor unit.

CITATION LIST

Patent Documents

Patent Document 1: Japanese Unexamined Patent Publication No. 2016-151395

SUMMARY

A first aspect of the present disclosure is directed to an air-conditioning system (1) that can be used together with a countermeasure device (60, 65) operating during leakage of a refrigerant. The air-conditioning system (1) includes: an air conditioner (10) including an outdoor unit (20) and a plurality of indoor units (30), each indoor unit (30) being provided in a corresponding one of a plurality of indoor spaces (A) and including a first control unit (33); and a second control unit (27) capable of communicating with the plurality of first control units (33). The air conditioner (10) includes a refrigerant circuit (10*a*) which is formed by connecting the outdoor unit (20) and the plurality of indoor units (30) together and through which the refrigerant circulates. Each first control unit (33) is capable of communicating with the countermeasure device (60, 65) if the countermeasure device (60, 65) is installed in correspondence with one of the indoor spaces (A) where the first control unit (33) is located. The second control unit (27) has a first function of prohibiting operation of the air conditioner (10) if a first condition where communication between the first control unit (33) and the countermeasure device (60, 65) is not established in any of the plurality of indoor units (30) is satisfied.

BRIEF DESCRIPTION OF THE DRAWINGS

FIG. 7 is a table showing refrigerants used in a refrigerant circuit of an air conditioner.

DESCRIPTION OF EMBODIMENTS

Figure 1:
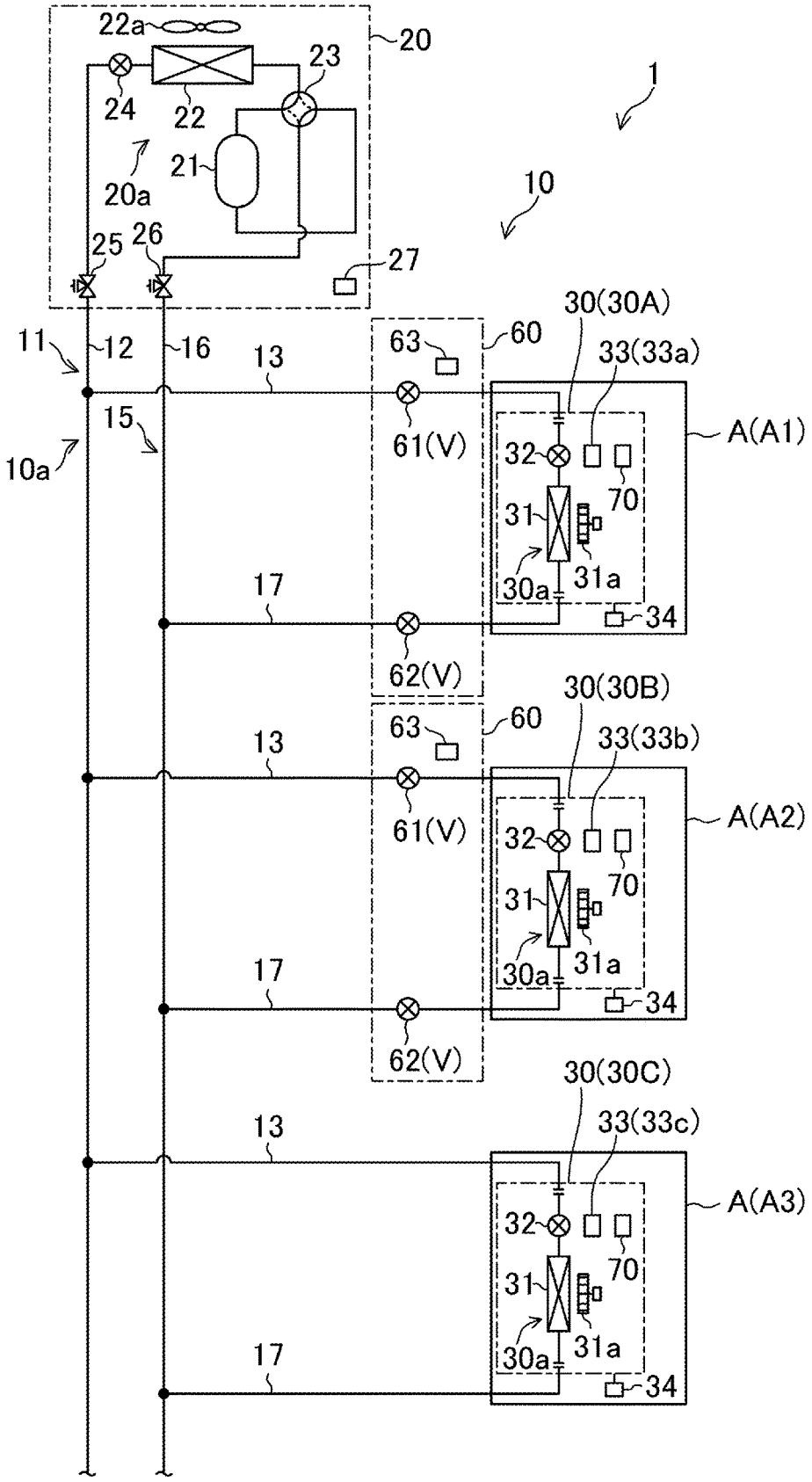
FIG. 1 is a piping system diagram showing a schematic configuration of an air-conditioning system according to an embodiment.
Figure 2:
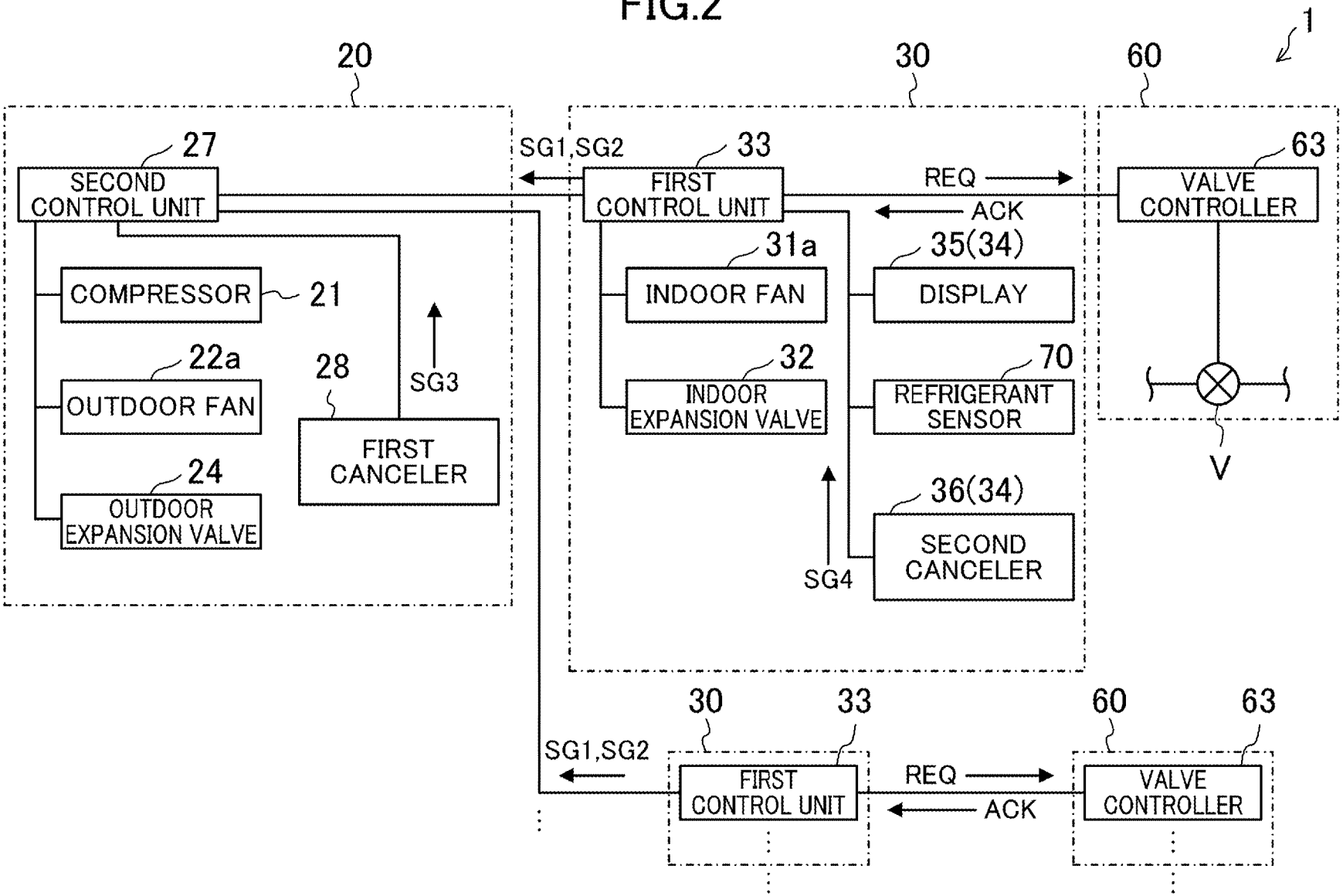
FIG. 2 is a block diagram illustrating a configuration of the air-conditioning system according to the embodiment.

Embodiments will now be described in detail with reference to the drawings. Note that the same reference characters denote the same or equivalent components in the drawings, and the description thereof will not be repeated.

<Outline of Air Conditioner>

An air-conditioning system (1) of the present embodiment includes an air conditioner (10). The air conditioner (10) conditions air in a plurality of indoor spaces (A). The plurality of indoor spaces (A) include indoor spaces (A1, A2, A3). As shown in FIG. 1, the air conditioner (10) of this example is configured as a multi-split air conditioner including an outdoor unit (20) and a plurality of indoor units (30). The plurality of indoor units (30) include indoor units (30A, 30B, 30C). The indoor unit (30A) is provided in the indoor space (A1). The indoor unit (30B) is provided in the indoor space (A2). The indoor unit (30C) is provided in the indoor space (A3). An indoor unit (30) provided in an indoor space (A) may be hereinafter referred to as an "indoor unit (30A)," an indoor unit (30) provided in an indoor space (B) as an "indoor unit (30B)," and an indoor unit (30) provided in an indoor space (C) as an "indoor unit (30C)." The indoor units (30A, 30B, 30C) have the same configuration. Thus, if these indoor units (30A, 30B, 30C) do not need to be described separately, these indoor units (30A, 30B, 30C) will be referred to as the "indoor units (30)." The air conditioner (10) of this example switches between cooling and heating for a target space. The number of the indoor units (30) is three in FIG. 1, but merely needs to be two or more.

The outdoor unit (20) is installed outdoors. The indoor units (30) are installed indoors. The outdoor unit (20) and the indoor units (30) of the air conditioner (10) are connected together via a connection pipe (11, 15).

The air conditioner (10) includes a refrigerant circuit (10*a*). The refrigerant circuit (10*a*) is filled with a refrigerant. The refrigerant circulates in the refrigerant circuit (10*a*)

to perform a vapor compression refrigeration cycle. The refrigerant circuit (10*a*) includes an outdoor circuit (20*a*) of the outdoor unit (20) and a plurality of indoor circuits (30*a*) provided in the corresponding indoor units (30). In the refrigerant circuit (10*a*), the plurality of indoor circuits (30*a*) are connected together in parallel. The outdoor circuit (20*a*) and the plurality of indoor circuits (30*a*) are connected together via the connection pipe (11, 15). In other words, the refrigerant circuit (10*a*) includes the outdoor unit (20) and the plurality of indoor units (30) connected together.

<Connection Pipe>

The connection pipe includes a liquid connection pipe (11) and a gas connection pipe (15).

The liquid connection pipe (11) includes a main liquid pipe (12) and a plurality of liquid branch pipes (13). The liquid branch pipes (13) correspond to first refrigerant flow paths. One end of the main liquid pipe (12) is connected to a liquid stop valve (25) of the outdoor circuit (20*a*). One end of each of the liquid branch pipes (13) is connected to the main liquid pipe (12). The other end of each of the liquid branch pipes (13) is connected to a liquid end (liquid-side coupling) of a corresponding one of the indoor circuits (30*a*).

The gas connection pipe (15) includes a main gas pipe (16) and a plurality of gas branch pipes (17). The gas branch pipes (17) correspond to second refrigerant flow paths. One end of the main gas pipe (16) is connected to a gas stop valve (26) of the outdoor circuit (20*a*). One end of each of the gas branch pipes (17) is connected to the main gas pipe (16). The other end of each of the gas branch pipes (17) is connected to a gas end (gas-side coupling) of a corresponding one of the indoor circuits (30*a*).

<Outdoor Unit>

As shown in FIG. 1, the air conditioner (10) includes one outdoor unit (20). The outdoor unit (20) includes a casing (not shown) housing the outdoor circuit (20*a*). The outdoor circuit (20*a*) is connected to a compressor (21), an outdoor heat exchanger (22), a four-way switching valve (23), an outdoor expansion valves (24), a gas stop valve (26), and a liquid stop valve (25). The compressor (21) compresses a refrigerant sucked thereinto and discharges the compressed refrigerant. The outdoor heat exchanger (22) exchanges heat between the refrigerant and outdoor air. An outdoor fan (22*a*) is provided adjacent to the outdoor heat exchanger (22). The outdoor fan (22*a*) transfers the outdoor air passing through the outdoor heat exchanger (22).

The four-way switching valve (23) switches between a first state indicated by solid curves in FIG. 1 and a second state indicated by broken curves in FIG. 1. The four-way switching valve (23) in the first state makes the discharge side of the compressor (21) and the gas end of the outdoor heat exchanger (22) communicate with each other, and makes the suction side of the compressor (21) and the gas stop valve (26) communicate with each other. The four-way switching valve (23) in the second state makes the discharge side of the compressor (21) and the gas stop valve (26) communicate with each other, and makes the suction side of the compressor (21) and the gas end of the outdoor heat exchanger (22) communicate with each other.

The outdoor expansion valve (24) is connected between the outdoor heat exchanger (22) and the liquid stop valve (25) in the outdoor circuit (20*a*). The outdoor expansion valve (24) is configured as an electronic expansion valve having an adjustable opening degree.

The outdoor unit (20) is provided with a second control unit (27). The second control unit (27) controls components including the compressor (21), the outdoor expansion valve (24), and the outdoor fan (22*a*) of the outdoor unit (20). The second control unit (27) includes a microcomputer mounted on a control board, and a memory device (specifically, a semiconductor memory) that stores software for operating the microcomputer. The second control unit (27) will be described in detail later.

The outdoor unit (20) is provided with a first canceler (28). The first canceler (28) includes buttons, switches, and other mechanisms for accepting an action. The first canceler (28) outputs a signal to the second control unit (27) in response to the accepted action. The first canceler (28) will be described in detail later.

<Indoor Unit>

As shown in FIG. 1, the air conditioner (10) includes a plurality of indoor units (30). The indoor units (30) are of a ceiling mounted type. The ceiling-mounted type as used herein includes a ceiling embedded type and a ceiling-suspended type. The indoor units (30) each include a casing (not shown) housing a corresponding one of the indoor circuits (30*a*). Each of the indoor circuits (30*a*) is connected to an indoor heat exchanger (31) and an indoor expansion valve (32). The indoor heat exchanger (31) exchanges heat between the refrigerant and indoor air. An indoor fan (31*a*) is provided adjacent to the indoor heat exchanger (31). The indoor fan (31*a*) transfers the indoor air passing through the indoor heat exchanger (31).

The indoor expansion valve (32) is connected between the liquid-side coupling and the indoor heat exchanger (31) in the indoor circuit (30*a*). The indoor expansion valve (32) is configured as an electronic expansion valve having an adjustable opening degree.

Each indoor unit (30) is provided with a first control unit (33). The first control unit (33) controls components including the indoor expansion valve (32) and the indoor fan (31*a*) of the indoor unit (30). The first control unit (33) includes a microcomputer mounted on a control board, and a memory device (specifically, a semiconductor memory) that stores software for operating the microcomputer. The first control unit (33) will be described in detail later. In the following description, the first control unit (33) provided in the indoor unit (30A) is referred to as the "first control unit (33*a*)," the first control unit (33) provided in the indoor unit (30B) as the "first control unit (33*b*)," and the first control unit (33) provided in the indoor unit (30C) as the "first control unit (33*c*)." The first control units (33*a*, 33*b*, 33*c*) have the same configuration. Thus, if these first control units (33*a*, 33*b*, 33*c*) do not need to be described separately, these first control units (33*a*, 33*b*, 33*c*) will be referred to as the "first control units (33)."

Each indoor unit (30) is connected to a remote control (34). Handling the remote control (34) triggers changes in the operating mode and set temperature of the corresponding indoor unit (30).

The remote controls (34) each include a display (35) and a second canceler (36). The display (35) is configured as a monitor. The display (35) displays the operating mode, set temperature, and other elements of the corresponding indoor unit in response to a signal input from the corresponding first control unit (33). The second canceler (36) includes buttons, switches, and other mechanisms for accepting an action. The second canceler (36) outputs a signal to the first control unit (33) in response to the accepted action. The display (35) and the second canceler (36) will be described in detail later.

<Cut-off Unit>

The air conditioner (10) includes a plurality of cut-off units (60). The cut-off units (60) are provided in one-to-one correspondence with the indoor circuits (30*a*) of the indoor units (30A) and (30B). The cut-off units (60) are each provided in correspondence with the liquid branch pipe (13) and the gas branch pipe (17) forming a pair. Each cut-off unit (60) cuts off the corresponding liquid branch pipe (13) and the corresponding gas branch pipe (17) while the refrigerant leaks from the corresponding indoor circuit (30*a*). The cut-off units (60) correspond to countermeasure devices. Note that the indoor unit (30C) is not provided with a cut-off unit (60). The number of the cut-off units (60) is two in FIG. 1, but may be zero, one, or three or more.

Each cut-off unit (60) includes a first cut-off valve (61) and a second cut-off valve (62). The first cut-off valve (61) is connected to the liquid branch pipe (13). The second cut-off valve (62) is connected to the gas branch pipe (17). The first cut-off valve (61) constitutes a cut-off valve (V) that cuts off the liquid branch pipe (13). The second cut-off valve (62) constitutes a cut-off valve (V) that cuts off the gas branch pipe (17). The first and second cut-off valves (61) and (62) are disposed outside the casing of the indoor unit (30).

The cut-off units (60) are each provided with a valve controller (63). The valve controller (63) controls components including the first and second cut-off valves (61) and (62) of the cut-off unit (60). The valve controller (63) includes a microcomputer mounted on a control board, and a memory device (specifically, a semiconductor memory) that stores software for operating the microcomputer. The valve controller (63) will be described in detail later.

<Refrigerant Sensor>

The air conditioner (10) includes refrigerant sensors (70). Each of the indoor units (30) includes one of the refrigerant sensors (70) of this example. The refrigerant sensors (70) of this example are each disposed inside the casing of the corresponding indoor unit (30). The refrigerant sensors (70) each detect leakage of the refrigerant from the indoor circuit (30*a*) of the corresponding indoor unit (30). The refrigerant sensors (70) may be each disposed outside the casing of the corresponding indoor unit (30).

<Second Control Unit>

The second control unit (27) is connected to the first control units (33) of the plurality of indoor units (30) via communication lines. The second control unit (27) can communicate with the plurality of first control units (33) via the communication lines. The second control unit (27) stores information on the plurality of indoor units (30) connected to the outdoor unit (20).

The second control unit (27) has a first function (interlock function) of prohibiting operation of the air conditioner (10). If a first condition where communication between the first control unit (33) and the valve controller (63) is not established in any of the indoor units (30) is satisfied, the second control unit (27) enables the first function. If a predetermined condition to be described later is satisfied, the second control unit (27) disables the enabled first function. In other words, if the predetermined condition is satisfied, the second control unit (27) cancels the first function.

If the first function is enabled, the second control unit (27) prohibits operation of the air conditioner (10). Specifically, if the first function is enabled, the second control unit (27) prohibits motions of the compressor (21), the outdoor fan (22*a*), and the outdoor expansion valve (24). If the first function is enabled, the second control unit (27) prohibits motions of the indoor fans (31*a*) and the indoor expansion valves (32) of the indoor units (30) via the plurality of first control units (33).

If the first function is disabled, the second control unit (27) permits operation of the air conditioner (10). Specifically, if the first function is disabled, the second control unit (27) permits motions of the compressor (21), the outdoor fan (22*a*), and the outdoor expansion valve (24). If the first function is disabled, the second control unit (27) permits motions of the indoor fans (31*a*) and the indoor expansion valves (32) of the indoor units (30) via the plurality of first control units (33).

<First Canceler>

The first canceler (28) accepts a first action for canceling the first function of the second control unit (27). The first canceler (28), when accepting the first action, outputs a third signal (SG3) to the second control unit (27). The second control unit (27), when receiving the third signal (SG3), cancels the first function. In other words, if the first canceler (28) accepts the first action for canceling the first function, the second control unit (27) cancels the first function to permit operation of the air conditioner (10).

<Second Canceler>

The second cancelers (36) each accept a second action for canceling the first function of the second control unit (27). Each of the second cancelers (36), when accepting the second action, outputs a fourth signal (SG4) to the corresponding first control unit (33).

<First Control Unit>

The first control units (33) are connected to the valve controllers (63) of the corresponding cut-off units (60) via communication lines. The first control units (33) communicate with the corresponding valve controllers (63).

The first control units (33), when connected to the corresponding valve controllers (63) via the communication lines, transmit and receive a signal to establish communication with the corresponding valve controllers (63). Motions performed by the first control units (33) to establish communication with the corresponding valve controllers (63) will be described in detail later.

If communication between the first control units (33) and the corresponding valve controllers (63) is established, the first control units (33) transmit a first signal (SG1) to the second control unit (27). The second control unit (27), when receiving the first signal (SG1) from the first control unit (33) of any one of the plurality of first control units (33), cancels the first function. In other words, if communication between at least one of the plurality of first control units (33) and the valve controller (63) of the corresponding cut-off unit (60) is established, the second control unit (27) cancels the first function to permit operation of the air conditioner (10).

The first control unit (33), when receiving the fourth signal (SG4) from the corresponding second canceler (36), transmits a second signal (SG2) to the second control unit (27). The second control unit (27), when receiving the second signals (SG2) from all of the plurality of first control units (33), cancels the first function. In other words, if all of the plurality of second cancelers (36) accept the second action, the second control unit (27) cancels the first function to permit operation of the air conditioner (10).

<Valve Controller>

Each valve controller (63) includes a communication section. The valve controller (63) communicates with the corresponding first control unit (33) via a communication line. The valve controller (63) controls the open/close status of each of the first and second cut-off valves (61) and (62) in accordance with a signal received from the first control unit (33). Specifically, the valve controller (63), when receiving a valve opening signal from the first control unit (33), controls the first and second cut-off valves (61) and (62) such that the first and second cut-off valves (61) and (62) are opened. The valve controller (63), when receiving a valve closing signal from the first control unit (33), controls the first and second cut-off valves (61) and (62) such that the first and second cut-off valves (61) and (62) are closed.

<Display>

Each display (35) displays information. For example, the display (35) displays information on operation conditions of the indoor unit (30). The display (35) displays the open/close status of the first cut-off valve (61) and the open/close status of the second cut-off valve (62) in response to the control by the first control unit (33).

If satisfaction of the first condition enables the first function of the second control unit (27), the display (35) indicates that the first condition has been satisfied. For example, the second control unit (27) notifies the first control units (33) that the first condition has been satisfied. Each first control unit (33) makes the display (35) display a code, an indication, or any other element indicating that the first condition has been satisfied.

Operation

The air conditioner (10) performs a cooling operation and a heating operation. Hereinafter, the cooling operation and the heating operation during a normal operation in which the refrigerant has not leaked will be described with reference to FIG. 1.

<Cooling Operation>

In the cooling operation, the four-way switching valve (23) is in the first state, and the first and second cut-off valves (61) and (62) are in the open state. The outdoor expansion valve (24) is opened. The opening degree of each of the indoor expansion valves (32) is controlled based on the degree of superheat of a corresponding one of the indoor heat exchangers (31). The outdoor fan (22*a*) and the indoor fans (31*a*) are actuated. The cooling operation involves performing a cooling cycle where the refrigerant dissipates heat and is condensed in the outdoor heat exchanger (22) and evaporates in the indoor heat exchangers (31).

The refrigerant compressed in the compressor (21) dissipates heat and is condensed in the outdoor heat exchanger (22) and passes through the outdoor expansion valve (24). This refrigerant diverges from the main liquid pipe (12) into the liquid branch pipes (13), and flows through the first cut-off valves (61) into the indoor circuits (30*a*). In each indoor circuit (30*a*), the refrigerant decompressed in the indoor expansion valve (32) evaporates in the indoor heat exchanger (31). In the indoor heat exchanger (31), the air is cooled by the evaporating refrigerant. The cooled air is supplied to the indoor space.

The refrigerant evaporated in each indoor heat exchanger (31) flows through the gas branch pipe (17), and then flows through the second cut-off valve (62). The flows of the refrigerant merge together in the main gas pipe (16) to be sucked into the compressor (21).

<Heating Operation>

In the heating operation, the four-way switching valve (23) is in the second state, and the first and second cut-off valves (61) and (62) are in the open state. The opening degree of the outdoor expansion valve (24) is controlled based on the degree of superheat of the refrigerant flowing out of the outdoor heat exchanger (22). The opening degree of each of the indoor expansion valves (32) is controlled based on the degree of subcooling of the refrigerant flowing out of the corresponding one of the indoor heat exchangers (31). The outdoor fan (22*a*) and the indoor fans (31*a*) are actuated. The heating operation involves performing a heating cycle where the refrigerant dissipates heat and is condensed in the indoor heat exchangers (31) and evaporates in the indoor heat exchangers (31).

The refrigerant compressed by the compressor (21) diverges from the main gas pipe (16) into the gas branch pipes (17), and flows through the second cut-off valves (62) into the indoor circuits (30*a*). In each indoor circuit (30*a*), the refrigerant dissipates heat and is condensed in the indoor heat exchanger (31). In the indoor heat exchanger (31), the air is heated by the refrigerant dissipating heat. The heated air is supplied to the indoor space.

The refrigerant that has dissipated heat in each indoor heat exchanger (31) flows through the liquid branch pipe (13), and then flows through the first cut-off valve (61). The flows of refrigerant merge in the main liquid pipe (12) to be decompressed in the outdoor expansion valve (24). The decompressed refrigerant flows through the outdoor heat exchanger (22). In the outdoor heat exchanger (22), the refrigerant absorbs heat from the outdoor air to evaporate. The evaporated refrigerant is sucked into the compressor (21).

Motions of Cut-Off Valves During Leakage of Refrigerant

The first and second cut-off valves (61) and (62) of this example are each configured to be kept in the open state described above during the normal operation. This allows the liquid branch pipes (13), the corresponding indoor circuits (30*a*), and the corresponding gas branch pipes (17) to communicate with one another, and enables the cooling and heating operations described above.

The leakage of the refrigerant from the indoor circuit (30*a*) of the indoor unit (30) during the cooling or heating operation causes the corresponding first and second cut-off valves (61) and (62) to be in the closed state. This motion allows the liquid branch pipe (13) and the gas branch pipe (17) to be cut off. This can immediately prevent the refrigerant in the outdoor circuit (20*a*), the main liquid pipe (12), and the main gas pipe (16) from leaking from the indoor circuit (30*a*) to the indoor space or any other space.

Motions Performed by First Control Unit To Establish Communication

Figure 3:
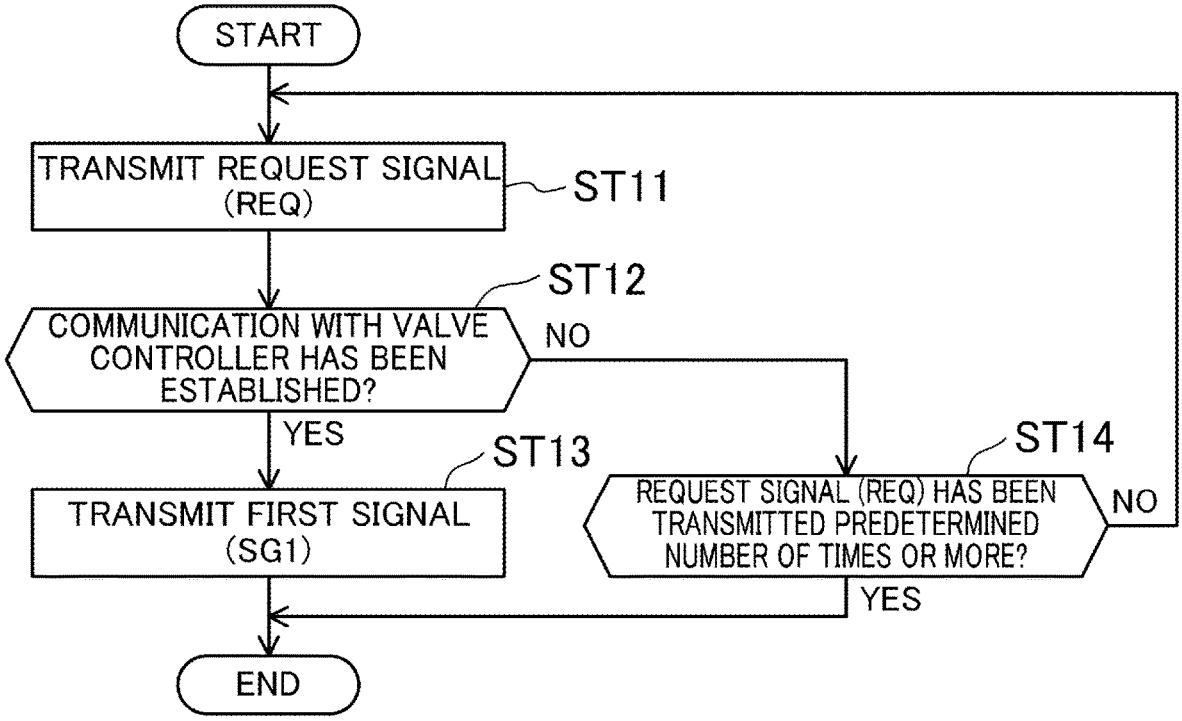
FIG. 3 is a flowchart for explaining motions performed by a first control unit to establish communication.

Next, the motions performed by each first control unit (33) to establish communication will be described in detail with reference to FIG. 3. In the embodiment, when the indoor units (30) and the cut-off units (60) are installed in the air-conditioning system (1), the first control units (33) are connected to the corresponding valve controllers (63) via communication lines or any other similar elements. The first control units (33), when connected to the corresponding valve controllers (63) via the communication lines, establish communication with the corresponding valve controllers (63).

In step (ST11), the first control units (33), when connected to the valve controllers (63) via the communication lines or any other similar elements, each transmit a request signal (REQ) to the valve controller (63) via the communication line. The request signal (REQ) is a signal to be transmitted to the valve controller (63) to request acknowledgment. The valve controller (63), when receiving the request signal (REQ), transmits an acknowledgment signal (ACK) to the first control unit (33) via the communication line. The acknowledgment signal (ACK) is a signal to be transmitted to notify the first control unit (33) that the valve controller (63) has received the request signal (REQ).

In step (ST12), the first control unit (33) determines whether or not communication with the valve controller (63) has been established. Specifically, the first control unit (33), when receiving the acknowledgment signal (ACK) after the transmission of the request signal (REQ) before a lapse of a predetermined time, determines that communication with the valve controller (63) has been established.

The first control unit (33), when determining that communication with the valve controller (63) has been established ("Yes" in step (ST12)), transmits the first signal (SG1) to the second control unit (27) (step (ST13)). The second control unit (27), by receiving the first signal (SG1) from the first control unit (33), can determine that communication between the first control unit (33) and the valve controller (63) has been established.

In step (ST12), the first control unit (33), when not receiving the acknowledgment signal (ACK) after the transmission of the request signal (REQ) before a lapse of the predetermined time, determines that communication with the valve controller (63) has not been established ("No" in step (ST12)). In this case, the first control unit (33) determines whether or not it has transmitted the request signal (REQ) a predetermined number of times or more (step (ST14)). If the first control unit (33) has transmitted the request signal (REQ) the predetermined number of times or more, the process is terminated. On the other hand, if the first control unit (33) has not transmitted the request signal (REQ) the predetermined number of times or more, the process returns to step (ST11).

As described above, the first control unit (33), when determining that communication with the valve controller (63) has been established, transmits the first signal (SG1) to the second control unit (27). In this example, each of the first control units (33) of the plurality of indoor units (30), when determining that communication with the corresponding valve controller (63) has been established, transmits the first signal (SG1) to the second control unit (27).

Processes Relating to First Function of Second Control Unit

Figure 4:
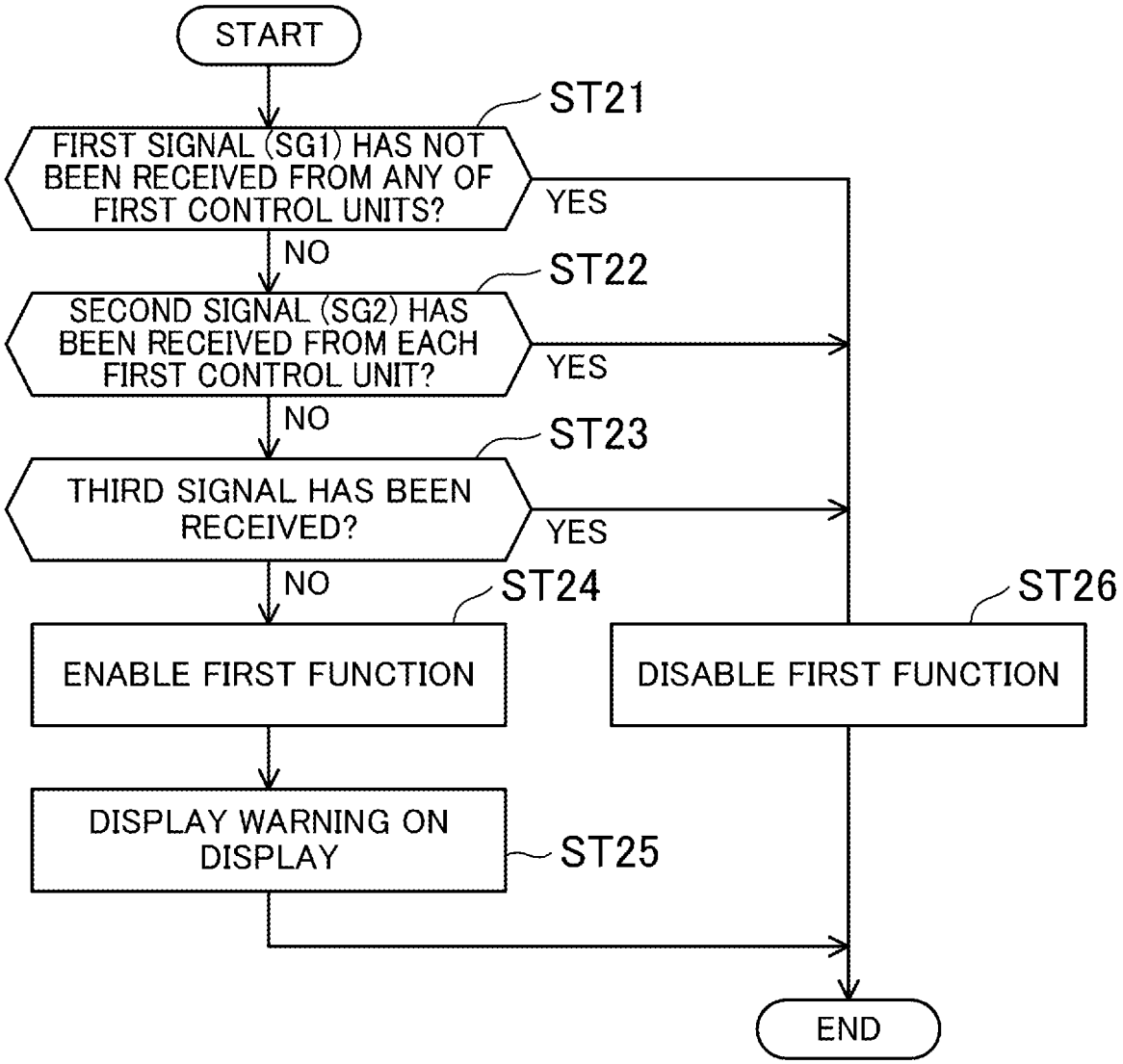
FIG. 4 is a flowchart for explaining processes relating to a first function of a second control unit.

Next, processes relating to the first function (interlock function) of the second control unit (27) will be described with reference to FIG. 4. The second control unit (27) enables or disables the first function in accordance with whether or not it has received the first, second, and third signals (SG1), (SG2), and (SG3).

In step (ST21), the second control unit (27) determines whether or not it has received the first signal (SG1) from any one of the plurality of first control units (33).

Each of the plurality of first control units (33), when determining that communication with the corresponding valve controller (63) is established, transmits the first signal (SG1) to the second control unit (27). The second control unit (27), when not receiving the first signal (SG1) from any of the plurality of first control units (33), determines that the first condition has been satisfied. The first condition is a condition where communication between the first control unit (33) and the cut-off unit (60) is not established in any of the indoor units (30).

If the second control unit (27) determines that it has not received the first signal (SG1) from any of the plurality of first control units (33) ("No" in step (ST21)), step (ST22) is performed. On the other hand, if the second control unit (27) determines that it has received the first signal (SG1) from at least one of the plurality of first control units (33) ("Yes" in step (ST21)), step (ST26) is performed.

In step (ST22), the second control unit (27), when receiving the second signals (SG2) from all of the first control units (33), determines that the second control unit (27) has received the second signals (SG2). Specifically, according to the configuration shown in FIG. 1, the second control unit (27), when receiving the second signal (SG2) from each of the first control units (33*a*, 33*b*, 33*c*), determines that the second control unit (27) has received the second signals (SG2).

The second canceler (36), when receiving the second action for canceling the first function, transmits the fourth signal (SG4) to the first control unit (33). The first control unit (33), when receiving the fourth signal (SG4) from the corresponding second canceler (36), transmits a second signal (SG2) to the second control unit (27). In other words, if all of the second cancelers (36) provided for the plurality of corresponding indoor units (30) receives the second action for canceling the first function, the second control unit (27) determines that the second control unit (27) has received the second signals (SG2).

If the second control unit (27) determines that it has not received the second signals (SG2) ("No" in step (ST22)), step (ST23) is performed. On the other hand, if the second control unit (27) determines that it has received the second signals (SG2) ("Yes" in step (ST22)), step (ST26) is performed.

In step (ST23), the second control unit (27) determines whether or not it has received the third signal (SG3). In the present embodiment, the first canceler (28), when receiving the first action for canceling the first function, outputs the third signal (SG3) to the second control unit.

If the second control unit (27) has not received the third signal (SG3) ("No" in step (ST23)), step (ST24) is performed. On the other hand, if the second control unit (27) has received the third signal (SG3) ("Yes" in step (ST23)), step (ST26) is performed.

In step (ST24), the second control unit (27) enables the first function. In other words, the second control unit (27) prohibits operation of the air conditioner (10). Specifically, the compressor (21) stops, and operations of all the indoor units (30) are prohibited.

In step (ST25), a warning is displayed on the display (35). Specifically, the second control unit (27) notifies the first control units (33) that the first condition has been satisfied. Each first control unit (33) makes the display (35) display a code, an indication, or any other element indicating that the first condition has been satisfied.

In step (ST26), the second control unit (27) disables the first function. In other words, the second control unit (27) permits operation of the air conditioner (10). Specifically, all the indoor units (30) can be operated.

Advantages of Embodiment

As can be seen from the foregoing description, the second control unit (27) has the first function of prohibiting operation of the air conditioner (10) if the first condition where communication between the first control unit (33) and the valve controller (63) is not established in any of the plurality of indoor units (30) is satisfied.

In the embodiment, if communication between the first control unit (33) and the valve controller (63) is not established in any of the plurality of indoor units (30), the second control unit (27) prohibits operation of the air conditioner (10). This can reduce the refrigerant leak.

The second control unit (27) prohibiting operation of the air conditioner (10) prevents all of the indoor units (30) from starting operating, even if an action of starting operation of the air conditioner (10) is performed via a remote control (34). Thus, a constructor or any other similar person can be notified that communication is not established.

In the embodiment, the outdoor unit (20) includes the first canceler (28) configured to accept the first action for canceling the first function. If the first canceler (28) accepts the first action, the second control unit (27) cancels the first function to permit operation of the air conditioner (10), even with the first condition satisfied.

In the embodiment, even if the first condition is satisfied, handling the first canceler (28) allows the air conditioner (10) to be operated.

In the embodiment, the plurality of indoor units (30) each include the second canceler (36) configured to accept the second action for canceling the first function. If all of the plurality of second cancelers (36) accept the second action, the second control unit (27) cancels the first function to permit operation of the air conditioner (10), even with the first condition satisfied.

In the embodiment, even if the first condition is satisfied, handling all of the second cancelers (36) allows the air conditioner (10) to be operated. In addition, to cancel the first function, all of the second cancelers (36) need to undergo the second action. This can further reduce leakage of the refrigerant.

In the embodiment, if communication between at least one of the plurality of first control units (33) and the valve controller (63) of the corresponding cut-off unit (60) is established, the second control unit (27) permits operation of the air conditioner (10).

In the embodiment, establishing communication between at least one of the plurality of first control units (33) and the corresponding valve controller (63) allows the air conditioner (10) to be operated.

Variations of Embodiment

Figure 5:
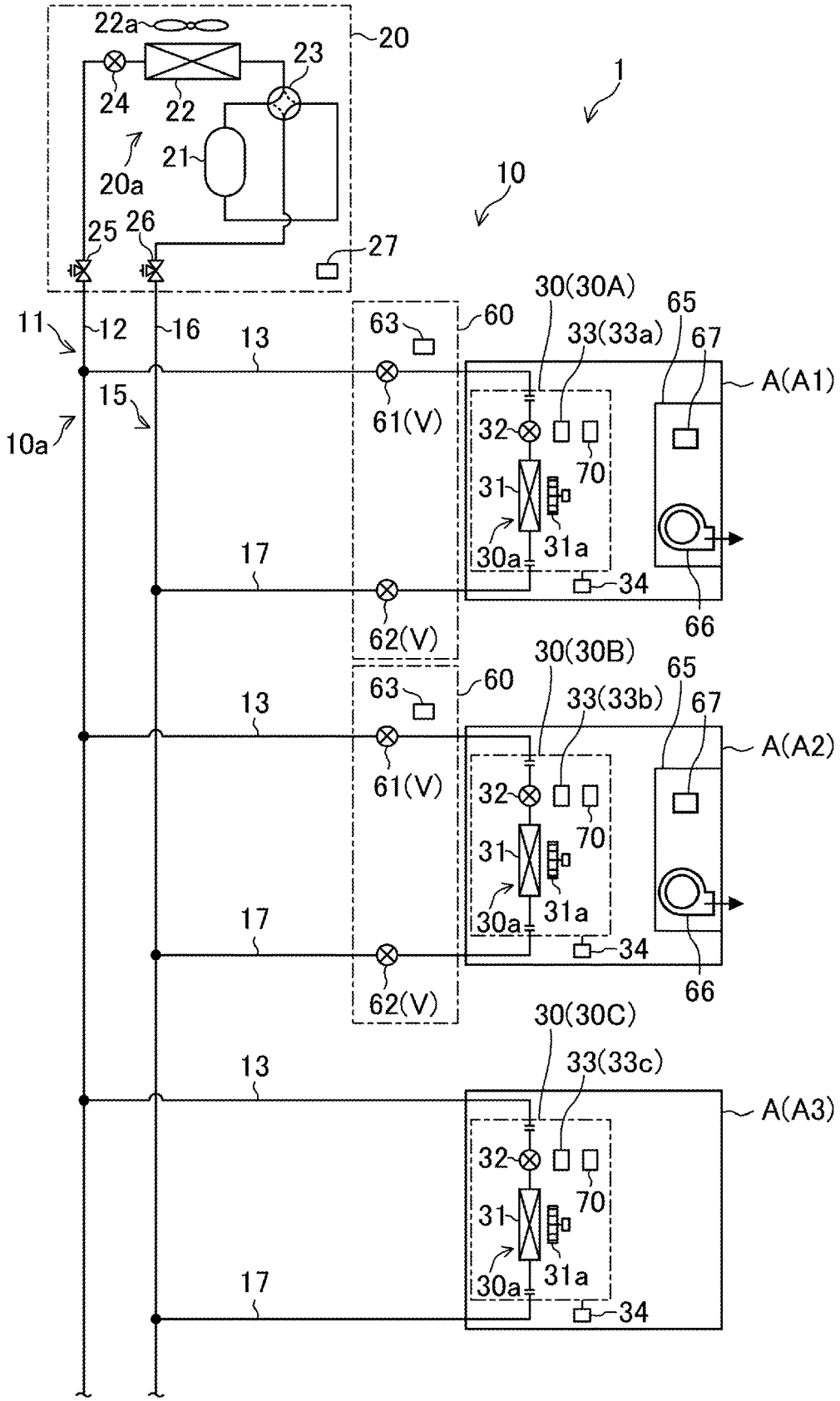
FIG. 5 is a piping system diagram illustrating a configuration of an air-conditioning system according to a variation of the embodiment.
Figure 6:
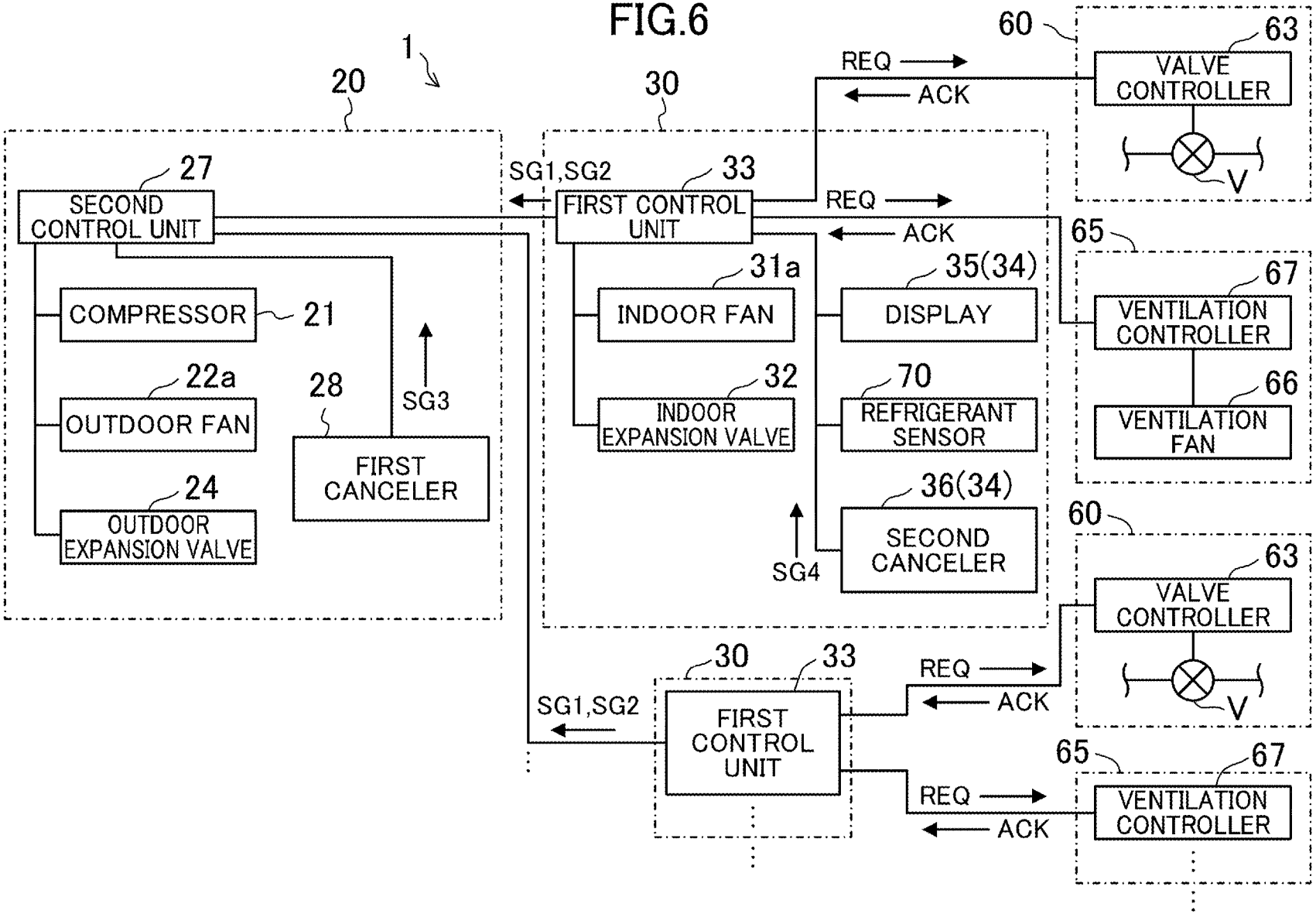
FIG. 6 is a block diagram illustrating a configuration of the air-conditioning system according to the variation of the embodiment.

As shown in FIGS. 5 and 6, the air-conditioning system (1) described above may include a plurality of ventilators (65). In this variation, cut-off units (60) and the ventilators (65) correspond to countermeasure devices. The plurality of ventilators (65) are each provided in correspondence with an indoor space (A). In FIG. 5, each of indoor spaces (A1, A2) is provided with one of the ventilators (65). Note that in FIG. 5, an indoor space (A3) is not provided with a ventilator (65). The number of the ventilators (65) is two in FIG. 5, but merely needs to be zero, one, or three or more.

Each of the plurality of ventilators (65) includes a ventilation fan (66) and a ventilation controller (67). The ventilation fan (66) is configured as, for example, a sirocco fan. The ventilation fan (66) performs a ventilation motion of discharging air in the indoor space (A) where the ventilation fan (66) is installed to an outdoor space, under a motion command from the ventilation controller (67). In the ventilation motion, while the air in the indoor space is discharged to the outdoor space, air in the outdoor space may be supplied into the indoor space.

Each ventilation controller (67) controls components including the ventilation fan (66). The ventilation controller (67) includes a microcomputer mounted on a control board, and a memory device (specifically, a semiconductor memory) that stores software for operating the microcomputer.

Each ventilation controller (67) is connected to a first control unit (33) of a corresponding one of indoor units (30) by a communication line. The ventilation controller (67) communicates with the first control unit (33) via the communication line. The ventilation controller (67) outputs the motion command to the ventilation fan (66) in response to a signal from the first control unit (33). For example, if a refrigerant sensor (70) detects leakage of a refrigerant, the corresponding first control unit (33) transmits a driving signal to the ventilation controller (67). The ventilation controller (67), when receiving the driving signal from the first control unit (33), outputs the motion command to the ventilation fan (66) to make the ventilation fan (66) perform a ventilation motion.

The first control units (33), when connected to the corresponding valve controllers (63) via the communication lines, establish communication with the corresponding valve controllers (63). A motion performed by each first control unit (33) to establish the communication is the same as, or similar to, that of the embodiment illustrated in FIG. 3. Thus, this motion will not be described.

In this variation, the first control units (33) when connected to the corresponding ventilation controllers (67) via the communication lines, establish communication with the corresponding ventilation controllers (67). A motion performed by each first control unit (33) to establish the communication is the same as, or similar to, the motion illustrated in FIG. 3 and performed to establish the communication between the first control unit (33) and the valve controller (63). Specifically, the first control unit (33), when connected to the ventilation controller (67) via the communications line or any other similar element, transmits a request signal (REQ) to the ventilation controller (67) via the communication line. The ventilation controller (67), when receiving the request signal (REQ), transmits an acknowledgment signal (ACK) to the first control unit (33) via the communication line. The first control unit (33), when receiving the acknowledgment signal (ACK) from the ventilation controller (67), determines that communication with the ventilation controller (67) has been established. The first control unit (33), when determining that communication with the ventilation controller (67) has been established, transmits a first signal (SG1) to the second control unit (27).

The second control unit (27) enables or disables the first function in accordance with whether or not it has received the first, second, and third signals (SG1), (SG2), and (SG3). A process in which the second control unit (27) enables or disables the first function is the same as, or similar to, that of the embodiment illustrated in FIG. 4. Thus, this process will not be described.

In this variation, the air-conditioning system (1) may include only the ventilators (65) out of the cut-off units (60) and the ventilators (65).

Other Embodiments

In the foregoing description, the outdoor unit (20) includes the first canceler (28), and the indoor units (30) each include the second canceler (36). However, this is merely an example. For example, only either the first canceler (28) or the second cancelers (36) may be provided. Alternatively, none of the first canceler (28) and the second cancelers (36) may be provided. If none of the first canceler (28) and the second cancelers (36) are provided, and the answer to step (ST21) is "No," the process in which the second control unit (27) enables or disables the first function and which is illustrated in FIG. 4 merely needs to proceed to step (ST24).

In the foregoing description, the refrigerant sensor (70) is provided in each of the indoor units (30), but does not have to be provided in the indoor unit (30), and may be provided in each of indoor spaces (A). In this case, one or more refrigerant sensors (70) merely need to be provided for each indoor space (A).

The indoor units (30) may be ceiling mounted type units, wall-hanging type units, floor standing type units, or any other unit.

The air-conditioning system (1) may be configured such that cut-off units (60) are retrofitted thereto, without including the cut-off units (60) at the time of shipment.

Each of the remote controls (34) may include an input section for accepting inputs from an inspector or any other similar person. If the input section receives cancellation information, the second control unit (27) may permit operation of the air conditioner (10).

Communication between each first control unit (33) and the corresponding valve controller (63) may be either wired or wireless, and communication between the first control unit (33) and the corresponding ventilation controller (67) may be either wired or wireless.

The cut-off units (60) may each include only either the first cut-off valve (61) or the second cut-off valve (62).

The cut-off unit (60) and the ventilator (65) as the countermeasure devices (60, 65) do not have to be provided in correspondence with each of the plurality of indoor spaces (A). Either the cut-off unit (60) or the ventilator (65) merely needs to be provided in any one of the indoor spaces (A).

(Refrigerant)

The refrigerants used in the refrigerant circuit (10*a*) of the air conditioner (10) of the embodiments and variations are flammable refrigerants. The flammable refrigerant includes refrigerants falling under Class 3 (highly flammable), Class 2 (less flammable), and Subclass 2L (mildly flammable) in the standards of ASHRAE34 Designation and safety classification of refrigerant in the United States or the standards of ISO817 Refrigerants-Designation and safety classification. FIG. 7 shows specific examples of the refrigerants used in the embodiments and the variations. In FIG. 7, "ASHRAE Number" indicates the ASHRAE number of each refrigerant defined in ISO 817, "Component" indicates the ASHRAE number of each substance contained in the refrigerant, "Mass %" indicates the concentration of each substance contained in the refrigerant by mass %, and "Alternative" indicates the name of an alternative to the substance of the refrigerant which is often replaced by the alternative. The refrigerant used in the present embodiment is R32. The examples of the refrigerants shown in FIG. 7 are characterized by having a higher density than air.

While the embodiments and variations have been described above, it will be understood that various changes in form and details can be made without departing from the spirit and scope of the claims. The above embodiments and variations may be appropriately combined or replaced as long as the functions of the target of the present disclosure are not impaired.

INDUSTRIAL APPLICABILITY

As can be seen from the foregoing description, the present disclosure is useful for an air-conditioning system including an air conditioner.

EXPLANATION OF REFERENCES

1 Air-conditioning System
10 Air Conditioner
10*a* Refrigerant Circuit
13 Liquid Branch Pipe
17 Gas Branch Pipe
20 Outdoor Unit
20*a* Outdoor Circuit
27 Second Control Unit
28 First Canceler
30 Indoor Unit
30*a* Indoor Circuit
33 First Control Unit
35 Display
36 Second Canceler
60 Cut-Off Unit
61 First Cut-Off Valve
62 Second Cut-Off Valve
63 Valve Controller
65 Ventilator
66 Ventilation Fan
67 Ventilation Controller
70 Refrigerant Sensor
V Cut-Off Valve

The invention claimed is:

1. An air-conditioning system that can perform a countermeasure procedure during leakage of a refrigerant, the air-conditioning system comprising:

an air conditioner including an outdoor unit and a plurality of indoor units, each indoor unit being provided in a corresponding one of a plurality of indoor spaces and including a first controller; and a second controller capable of communicating with the plurality of first controllers, the air conditioner including a refrigerant circuit which is formed by connecting the outdoor unit and the plurality of indoor units together and through which the refrigerant circulates, each first controller being capable of communicating with a countermeasure device that is in correspondence with one of the indoor spaces where the first controller is located, the second controller having a first function of prohibiting operation of all of the indoor units if a first condition where communication between the first controller and the countermeasure device is not established in each of the plurality of indoor units is satisfied, the second controller permitting the operation of all of the indoor units if communication between one of the plurality of first controllers and the countermeasure device is established, wherein the second controller is provided in the outdoor unit, the outdoor unit includes a compressor that is connected to the refrigerant circuit, and the second controller prohibits operation of the compressor when the first condition is satisfied.

2. The air-conditioning system of claim 1, wherein the plurality of first controllers each transmit a first signal to the second controller if communication with the countermeasure device is established, and the first condition includes the second controller not receiving the first signal from any of the plurality of first controllers.

3. The air-conditioning system of claim 1, further comprising:

a display indicating that the first condition has been satisfied, when satisfaction of the first condition causes the operation of the air conditioner to be prohibited.

4. The air-conditioning system of claim 1, wherein the refrigerant circuit includes indoor circuits each provided in a corresponding one of the indoor units, first refrigerant flow paths each connected to a liquid end portion of a corresponding one of the indoor circuits, and second refrigerant flow paths each connected to a gas end portion of a corresponding one of the indoor circuits, the countermeasure device includes at least one of a cut-off valve provided in one or each of the corresponding first and second refrigerant flow paths, or a ventilator configured to ventilate a corresponding one of the indoor spaces.

5. The air-conditioning system of claim 2, further comprising:

a display indicating that the first condition has been satisfied, when satisfaction of the first condition causes the operation of the air conditioner to be prohibited.

6. The air-conditioning system of claim 2, wherein the refrigerant circuit includes indoor circuits each provided in a corresponding one of the indoor units, first refrigerant flow paths each connected to a liquid end portion of a corresponding one of the indoor circuits, and second refrigerant flow paths each connected to a gas end portion of a corresponding one of the indoor circuits, the countermeasure device includes at least one of a cut-off valve provided in one or each of the corresponding first and second refrigerant flow paths, or a ventilator configured to ventilate a corresponding one of the indoor spaces.

7. The air-conditioning system of claim 3, wherein the refrigerant circuit includes indoor circuits each provided in a corresponding one of the indoor units, first refrigerant flow paths each connected to a liquid end portion of a corresponding one of the indoor circuits, and second refrigerant flow paths each connected to a gas end portion of a corresponding one of the indoor circuits, the countermeasure device includes at least one of a cut-off valve provided in one or each of the corresponding first and second refrigerant flow paths, or a ventilator configured to ventilate a corresponding one of the indoor spaces.

8. An air-conditioning system that can perform a countermeasure procedure during leakage of a refrigerant, the air-conditioning system comprising:

an air conditioner including an outdoor unit and a plurality of indoor units, each indoor unit being provided in a corresponding one of a plurality of indoor spaces and including a first controller; and a second controller capable of communicating with the plurality of first controllers, the air conditioner including a refrigerant circuit which is formed by connecting the outdoor unit and the plurality of indoor units together and through which the refrigerant circulates, each first controller being capable of communicating with a countermeasure device that is in correspondence with one of the indoor spaces where the first controller is located, the second controller permitting operation of all of the indoor units if communication between one of the plurality of first controllers and the countermeasure device is established, the second controller having a first function of prohibiting operation of the air conditioner if a first condition where communication between the first controller and the countermeasure device is not established in each of the plurality of indoor units is satisfied, the outdoor unit including a first canceler configured to accept a first action for canceling the first function, and if the first canceler accepts the first action, the second controller cancels the first function to permit the operation of the air conditioner, even with the first condition satisfied, wherein the second controller is provided in the outdoor unit, the outdoor unit includes a compressor that is connected to the refrigerant circuit, and the second controller prohibits operation of the compressor when the first condition is satisfied.

9. The air-conditioning system of claim 8, further comprising:

a display indicating that the first condition has been satisfied, when satisfaction of the first condition causes the operation of the air conditioner to be prohibited.

10. The air-conditioning system of claim 8, wherein the refrigerant circuit includes indoor circuits each provided in a corresponding one of the indoor units, first refrigerant flow paths each connected to a liquid end portion of a corresponding one of the indoor circuits, and second refrigerant flow paths each connected to a gas end portion of a corresponding one of the indoor circuits, the countermeasure device includes at least one of a cut-off valve provided in one or each of the corresponding first and second refrigerant flow paths, or a ventilator configured to ventilate a corresponding one of the indoor spaces.

11. An air-conditioning system that can perform a countermeasure procedure during leakage of a refrigerant, the air-conditioning system comprising:

an air conditioner including an outdoor unit and a plurality of indoor units, each indoor unit being provided in a corresponding one of a plurality of indoor spaces and including a first controller; and a second controller capable of communicating with the plurality of first controllers, the air conditioner including a refrigerant circuit which is formed by connecting the outdoor unit and the plurality of indoor units together and through which the refrigerant circulates, each first controller being capable of communicating with a countermeasure device that is in correspondence with one of the indoor spaces where the first controller is located, the second controller permitting operation of all of the indoor units if communication between one of the plurality of first controllers and the countermeasure device is established, the second controller having a first function of prohibiting operation of the air conditioner if a first condition where communication between the first controller and the countermeasure device is not established in each of the plurality of indoor units is satisfied, the plurality of indoor units each including a second canceler configured to accept a second action for canceling the first function, and if all of the second cancelers accept the second action, the second controller cancels the first function to permit the operation of the air conditioner, even with the first condition satisfied, wherein the second controller is provided in the outdoor unit, the outdoor unit includes a compressor that is connected to the refrigerant circuit, and the second controller prohibits operation of the compressor when the first condition is satisfied.

12. The air-conditioning system of claim 11, further comprising:

a display indicating that the first condition has been satisfied, when satisfaction of the first condition causes the operation of the air conditioner to be prohibited.

13. The air-conditioning system of claim 11, wherein the refrigerant circuit includes indoor circuits each provided in a corresponding one of the indoor units, first refrigerant flow paths each connected to a liquid end portion of a corresponding one of the indoor circuits, and second refrigerant flow paths each connected to a gas end portion of a corresponding one of the indoor circuits, the countermeasure device includes at least one of a cut-off valve provided in one or each of the corresponding first and second refrigerant flow paths, or a ventilator configured to ventilate a corresponding one of the indoor spaces.

* * * * *